US007294031B1

(12) United States Patent
Davis et al.

(10) Patent No.: US 7,294,031 B1
(45) Date of Patent: Nov. 13, 2007

(54) MARINE DRIVE GROMMET SEAL

(75) Inventors: Richard A. Davis, Mequon, WI (US); Christopher J. Nelson, Mount Prospect, IL (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/586,191

(22) Filed: Oct. 25, 2006

Related U.S. Application Data

(63) Continuation-in-part of application No. 11/255,510, filed on Oct. 21, 2005, now Pat. No. 7,188,581, and a continuation-in-part of application No. 11/255,718, filed on Oct. 21, 2005, now Pat. No. 7,234,983.

(51) Int. Cl.
*B63H 23/36* (2006.01)

(52) U.S. Cl. ..... 440/112

(58) Field of Classification Search ..... 440/112
See application file for complete search history.

(56) References Cited

U.S. PATENT DOCUMENTS

| | | | | |
|---|---|---|---|---|
| 2,977,923 | A | 4/1961 | Bergstedt | |
| 3,982,496 | A | 9/1976 | Blanchard | |
| 4,040,378 | A | 8/1977 | Blanchard | |
| 4,236,478 | A * | 12/1980 | Mansson | 440/112 |
| 5,108,325 | A | 4/1992 | Livingston et al. | |
| 5,230,644 | A | 7/1993 | Meisenburg et al. | |
| 5,366,398 | A | 11/1994 | Meisenburg et al. | |
| 5,386,368 | A | 1/1995 | Knight | |
| 5,403,216 | A | 4/1995 | Salmi et al. | |
| 5,415,576 | A | 5/1995 | Meisenburg et al. | |
| 5,425,663 | A | 6/1995 | Meisenburg et al. | |
| 5,685,253 | A | 11/1997 | Alexander, Jr. | |
| 5,735,718 | A | 4/1998 | Ekwall | |
| 5,755,605 | A | 5/1998 | Asberg | |
| 6,138,601 | A | 10/2000 | Anderson et al. | |
| 6,142,841 | A | 11/2000 | Alexander et al. | |
| 6,230,642 | B1 | 5/2001 | McKenney et al. | |
| 6,234,853 | B1 | 5/2001 | Lanyi et al. | |
| 6,354,235 | B1 | 3/2002 | Davies | |
| 6,357,375 | B1 | 3/2002 | Ellis | |
| 6,386,930 | B2 | 5/2002 | Moffet | |
| 6,431,928 | B1 | 8/2002 | Aamivuo | |
| 6,439,937 | B1 | 8/2002 | Mansson et al. | |

(Continued)

FOREIGN PATENT DOCUMENTS

WO WO-2003/042036 5/2003

(Continued)

OTHER PUBLICATIONS

Marine Technology Society Dynamic Positioning Committee Conference Thrusters Session entitled *Compact Azipod® Propulsion on DT Supply Vessels*, presented by Strand et al., held in Oslo, Norway, Sep. 18-19, 2001.

(Continued)

*Primary Examiner*—Stephen Avila
(74) *Attorney, Agent, or Firm*—Andrus, Sceales, Starke & Sawall, LLP

(57) ABSTRACT

A marine vessel and drive combination has upper and lower mounting plates mounting a marine propulsion device to a hull at an opening with a sealing grommet.

19 Claims, 14 Drawing Sheets

U.S. PATENT DOCUMENTS

| | | | |
|---|---|---|---|
| 6,447,349 | B1 | 9/2002 | Fadeley et al. |
| 6,511,354 | B1 | 1/2003 | Gonring et al. |
| 6,582,259 | B1 | 6/2003 | Mansson et al. |
| 6,623,320 | B1 | 9/2003 | Hedlund |
| 6,638,124 | B2 | 10/2003 | Zoubul et al. |
| 6,688,927 | B2 | 2/2004 | Aamivuo |
| 6,705,907 | B1 | 3/2004 | Hedlund |
| 6,712,654 | B1 | 3/2004 | Putaansuu |
| 6,783,410 | B2 | 8/2004 | Florander et al. |
| 6,942,531 | B1 | 9/2005 | Fell et al. |
| 6,952,180 | B2 | 10/2005 | Jonsson et al. |
| 2002/0127928 | A1 | 9/2002 | Buzzi |
| 2002/0197918 | A1 | 12/2002 | Aamivuo |
| 2003/0161730 | A1 | 1/2003 | Nestvall |
| 2003/0166362 | A1 | 9/2003 | Varis |
| 2003/0230636 | A1 | 12/2003 | Varis |
| 2004/0014380 | A1 | 1/2004 | Varis et al. |
| 2004/0149003 | A1 | 8/2004 | Nestvall |
| 2004/0214484 | A1 | 10/2004 | Ylitalo |
| 2005/0272321 | A1 | 12/2005 | Mansson |

FOREIGN PATENT DOCUMENTS

| | | |
|---|---|---|
| WO | WO-2003/072431 | 9/2003 |
| WO | WO-2003/074355 | 9/2003 |
| WO | WO-2003/093102 | 11/2003 |
| WO | WO-2003/093105 | 11/2003 |
| WO | WO-2003/093106 | 11/2003 |
| WO | WO-2003/093107 | 11/2003 |
| WO | WO-2004/113162 | 4/2004 |
| WO | WO-2004/068082 | 8/2004 |
| WO | WO-2004/074089 | 9/2004 |

OTHER PUBLICATIONS

Marine Technology Society Dynamic Positioning Committee Conference Thrusters Session entitled *New Thruster Concept for Station Keeping and Electric Propulsion*, presented by Adnanses et al., held in Helsinki, Finland, Sep. 18-19, 2001.

Department of Marine Technology, Norwegian University of Science and Technology, presentation entitled *Dynamically Positioned and Thruster Assisted Positioned Moored Vessels*, presented by Professor Asgeir J. Sorensen, held in Trondhelm, Norway.

Dec. 2004 Boating Business article entitled: *Changing Boating Forever*.

Jan. 2005 Boating Magazine article by David Seidman entitled *Short Shafted*.

OXTS Inertial+GPS: OXTS—Oxford Technical Solutions—RT3040 (http.??oxts.com/product) last visited Sep. 30, 2005.

* cited by examiner

FIG. 13
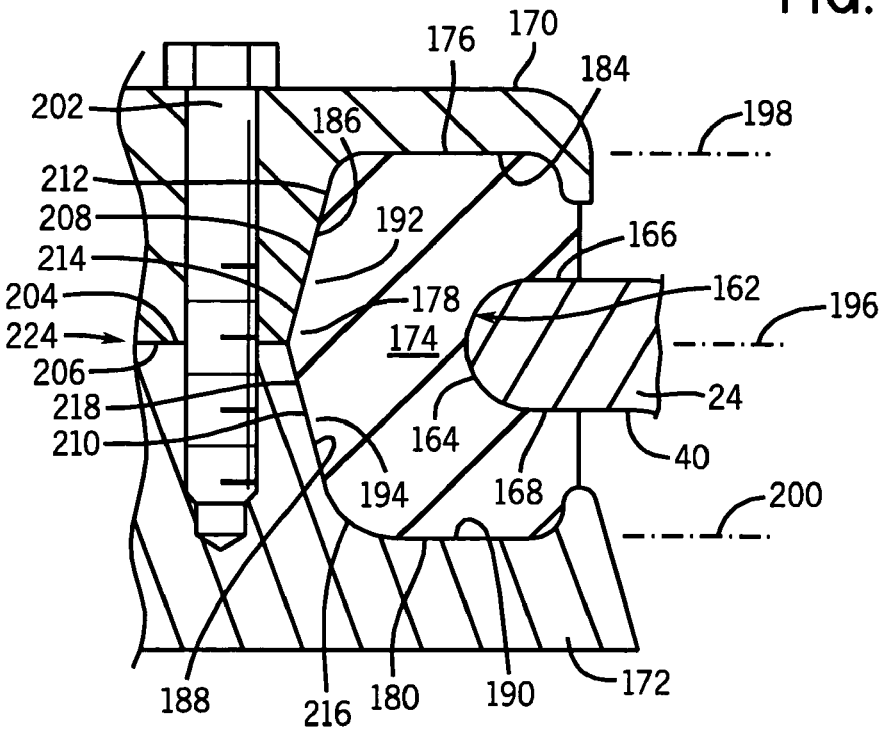
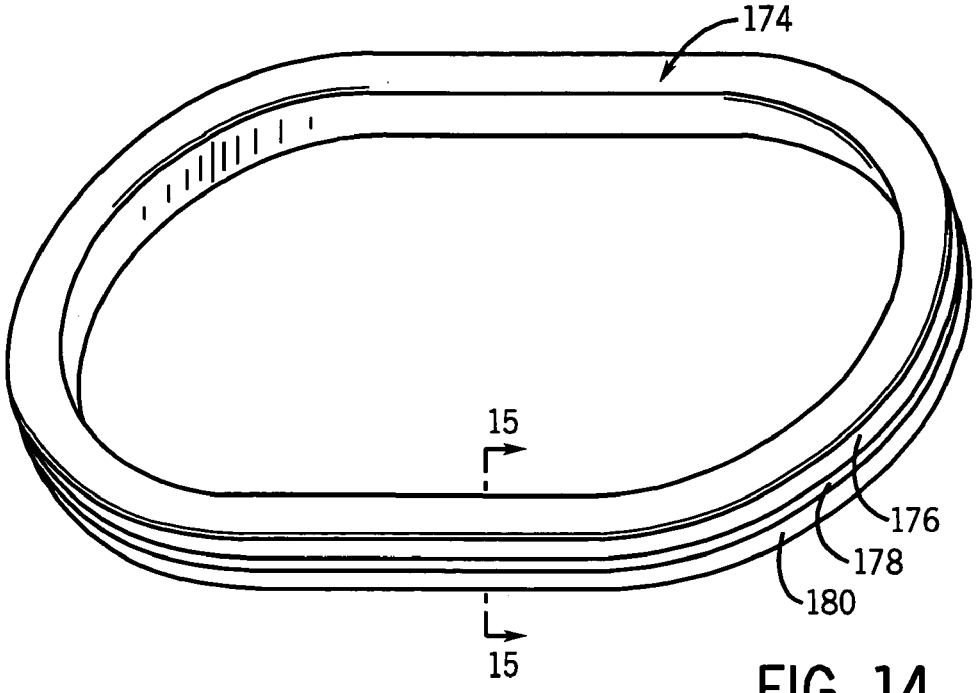
FIG. 14

MARINE DRIVE GROMMET SEAL

CROSS-REFERENCE TO RELATED APPLICATIONS

The present application is a continuation-in-part of U.S. patent application Ser. No. 11/255,510, filed Oct. 21, 2005, now U.S. Pat. No. 7,188,581 and a continuation-in-part of U.S. patent application Ser. No. 11/255,718, filed Oct. 21, 2005, now U.S. Pat. No. 7,234,983.

BACKGROUND AND SUMMARY

Marine vessels having a drive unit extending downwardly through the hull are known in the prior art, for example a Mercury Marine L-drive as shown in U.S. Pat. No. 5,108,325, a Volvo IPS (inboard propulsion system) drive, and ABB (Asea Brown Bavari) azipod drives.

The present invention arose during continuing development efforts related to marine vessel and drive combinations.

BRIEF DESCRIPTION OF THE DRAWINGS

Parent Application

FIG. 1 is a perspective view of a marine vessel and drive combination in accordance with the '718 application.

FIG. 2 is a bottom elevation view of the combination of FIG. 1.

FIG. 3 is a side elevation view of the combination of FIG. 1.

FIG. 4 is a rear or aft elevation view of the combination of FIG. 1.

FIG. 5 is an enlarged view of a portion of FIG. 3.

FIG. 6 is an enlarged view of a portion of FIG. 2.

FIG. 7 is like FIG. 6 and shows a different steering orientation.

FIG. 8 is like FIG. 6 and shows another different steering orientation.

FIG. 9 is an enlarged view of a portion of FIG. 1.

FIG. 10 is like FIG. 9 and shows a further operational embodiment.

FIG. 11 is a side view showing the arrangement of an engine and marine propulsion device used in conjunction with the '718 application

Present Application

Figure 11:
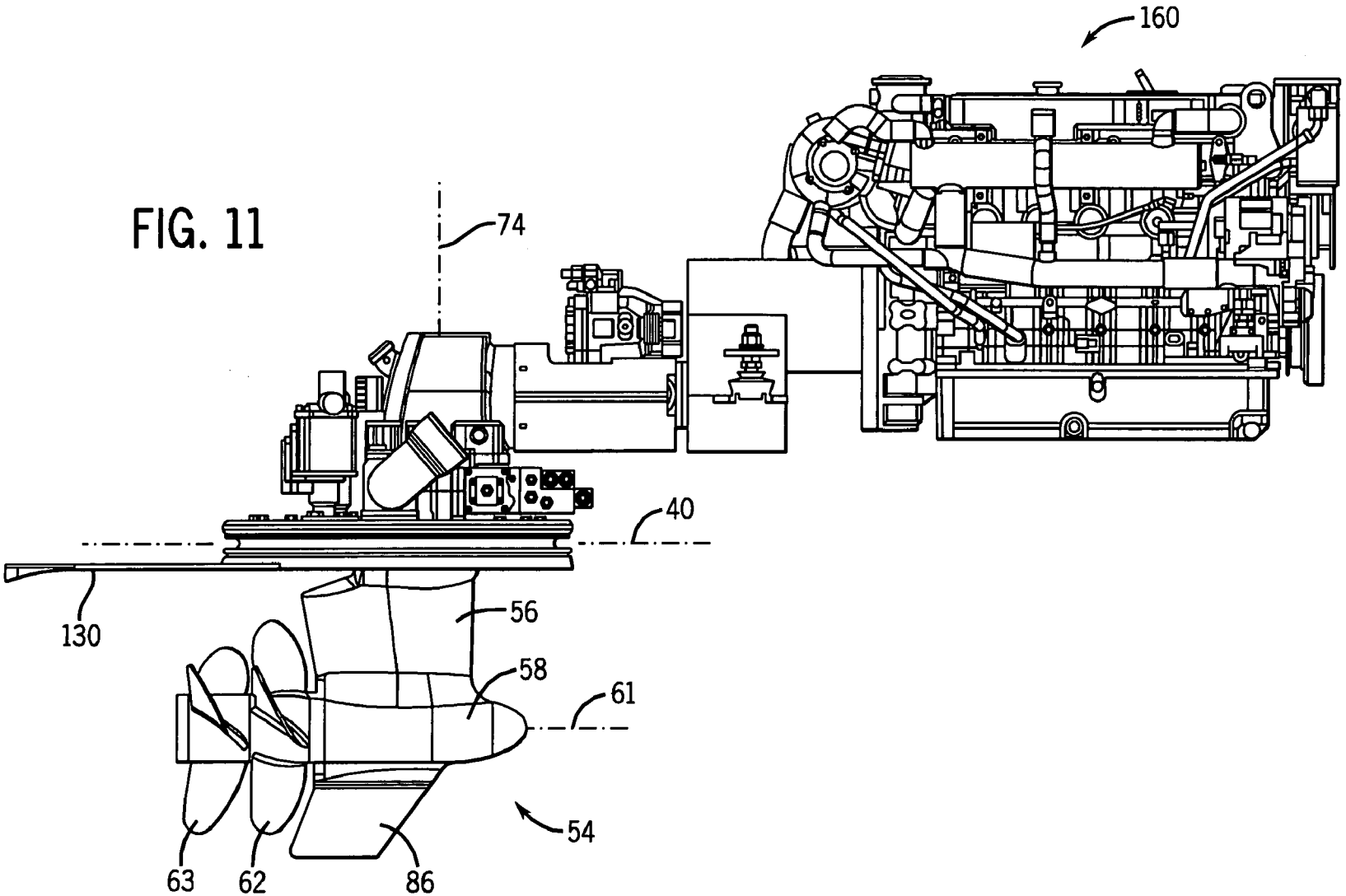
Figure 12:
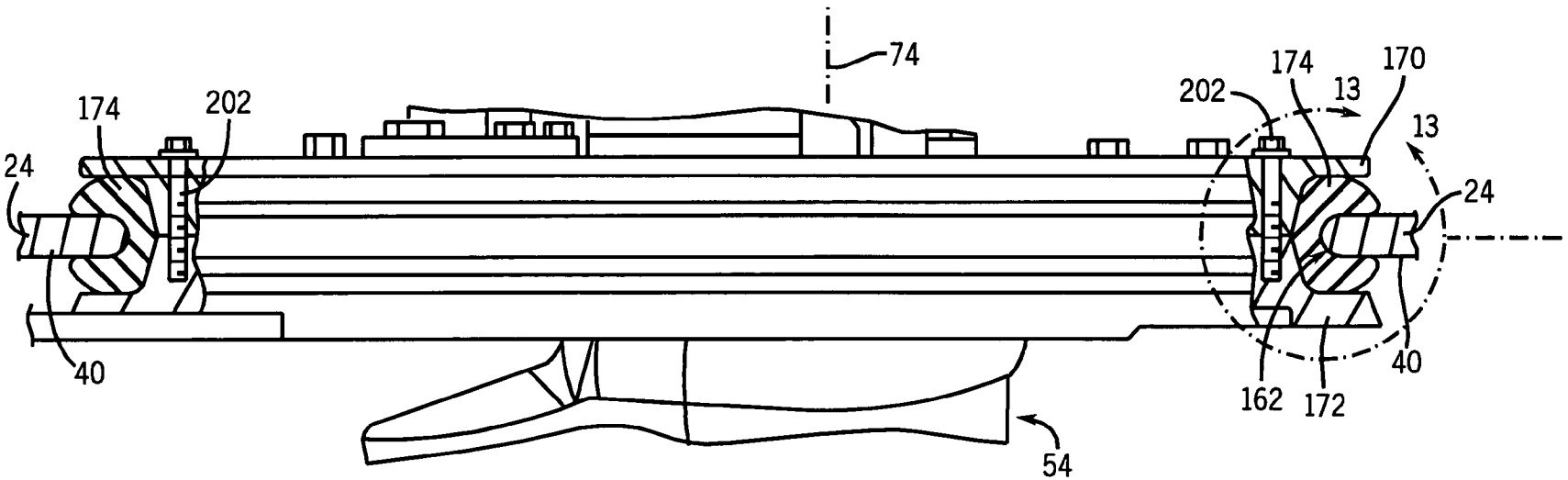

FIG. 12 is an enlarged sectional view like a portion of FIG. 11 and showing the present invention.

FIG. 13 is an enlarged view of a portion of FIG. 12 along line 13-13.

FIG. 14 is a perspective view of a component of FIG. 12.

Figure 15:
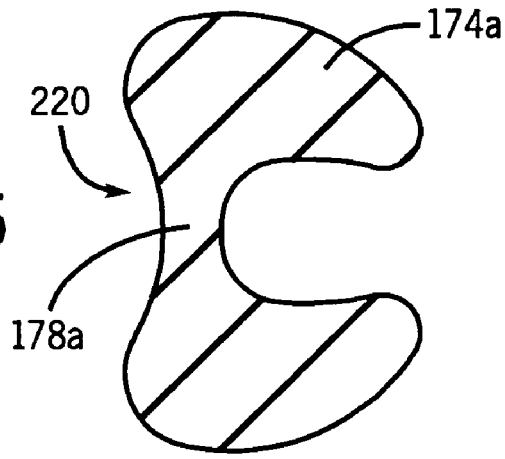

FIG. 15 is a sectional view taken along line 15-15 of FIG. 14 and showing an alternate embodiment.

Figure 16:
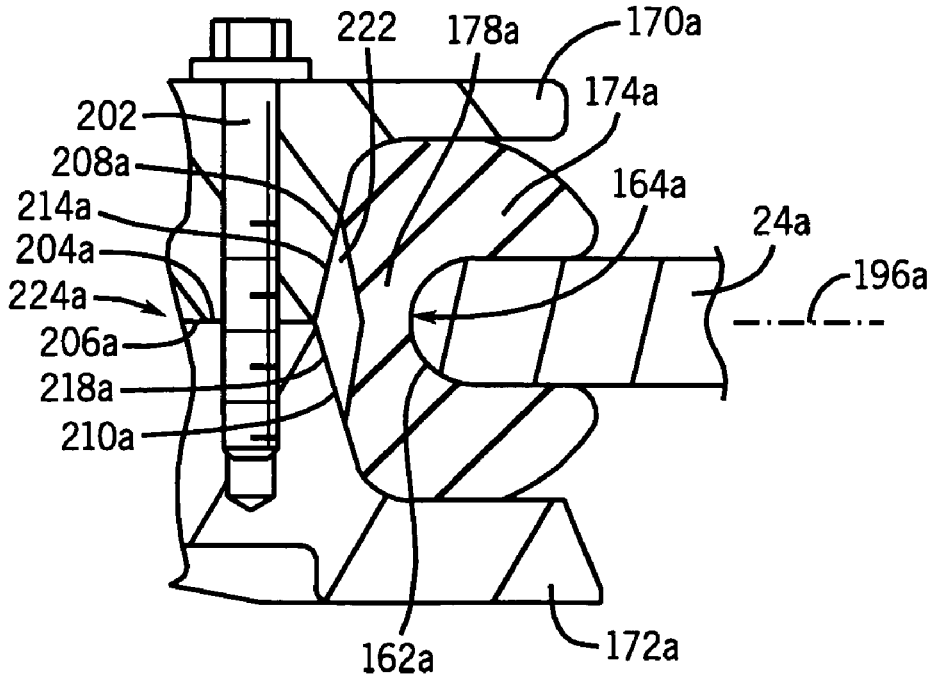

FIG. 16 is like FIG. 13 and shows an alternate embodiment.

DETAILED DESCRIPTION

Parent Application

The following description is taken from the noted parent '718 application.

FIGS. 1-4 show a marine vessel and drive combination. Marine vessel 22 includes a hull 24 having a longitudinally extending keel 26 having a lower reach 28. The hull has port and starboard lower hull surfaces 30 and 32, respectively, extending upwardly and laterally distally oppositely from keel 26 in V-shaped relation, FIG. 4. Hull 24 extends forwardly from a stern 34 to a bow 36.

Figure 2:
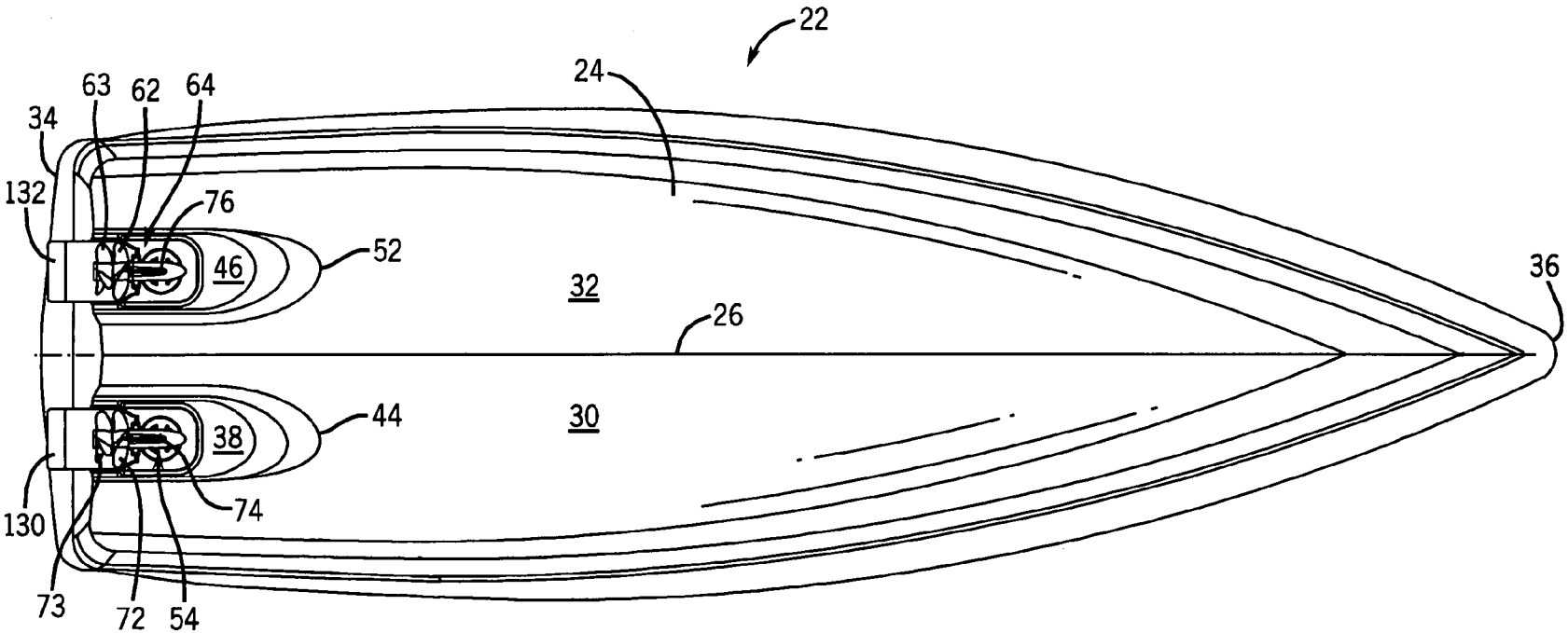
Figure 3:
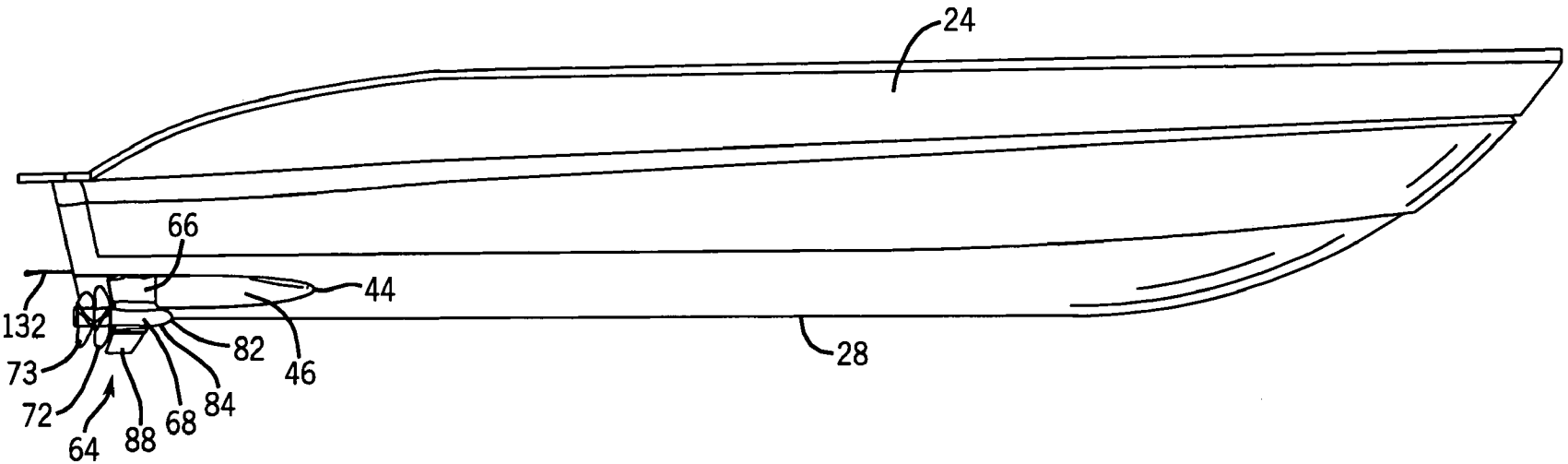

A port tunnel 38, FIG. 2, is formed in port lower hull surface 30. Port tunnel 38 has a top 40, FIG. 4, spaced above an open bottom 42 at port lower hull surface 30. Port tunnel 38 opens aft at stern 34 and extends forwardly therefrom and has a closed forward end 44 aft of bow 36. A starboard tunnel 46 is formed in starboard lower hull surface 32. Starboard tunnel 46 has a top 48 spaced above an open bottom 50 at starboard lower hull surface 32. Starboard tunnel 46 opens aft at stern 34 and extends forwardly therefrom and has a closed forward end 52 aft of bow 36.

A port marine propulsion device 54 includes a port driveshaft housing 56 extending downwardly in port tunnel 38 to a port lower gear case 58, e.g. including a torpedo-shaped housing as is known, supporting at least one port propeller shaft 60 driving at least one water-engaging propulsor such as port propeller 62, and preferably a pair of propeller shafts driving counter-rotating propellers 62, 63, as is known, for example U.S. Pat. Nos. 5,108,325, 5,230,644, 5,366,398, 5,415,576, 5,425,663, all incorporated herein by reference. Starboard marine propulsion device 64 is comparable and includes a starboard driveshaft housing 66 extending downwardly in starboard tunnel 46 to starboard lower gear case 68, e.g. provided by the noted torpedo-shaped housing, supporting at least one starboard propeller shaft 70 driving at least one starboard propeller 72, and preferably a pair of counter-rotating starboard propellers 72, 73, as above. The port and starboard marine propulsion devices 54 and 64 are steerable about respective port and starboard vertical steering axes 74 and 76, comparably as shown in commonly owned co-pending U.S. patent application Ser. No. 11/248,482, filed Oct. 12, 2005, and application Ser. No. 11/248,483, filed Oct. 12, 2005, incorporated herein by reference. Port steering axis 74 extends through the top 40 of port tunnel 38. Starboard steering axis 76 extends through the top 48 of starboard tunnel 46.

Figure 4:
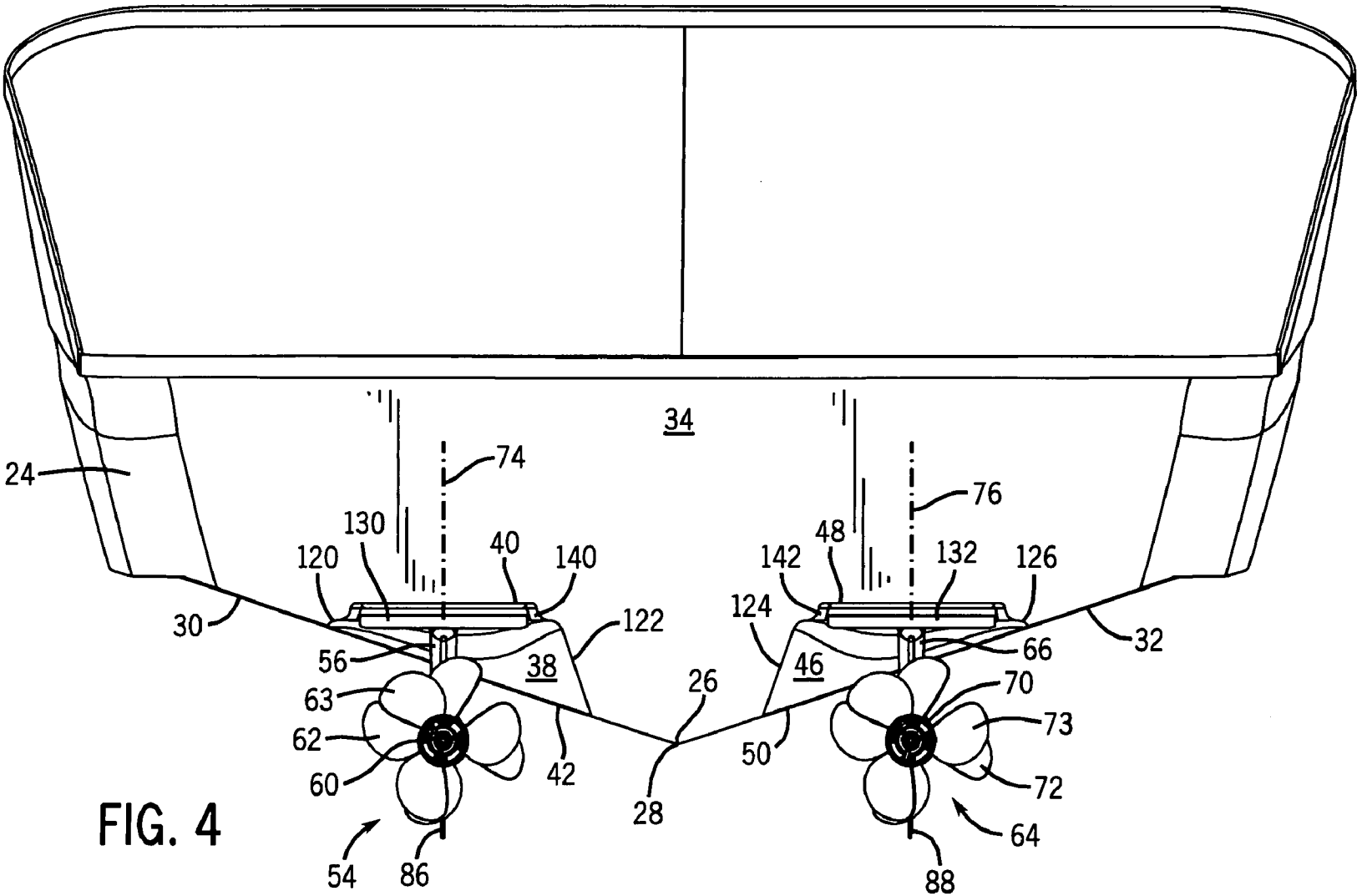
Figure 5:
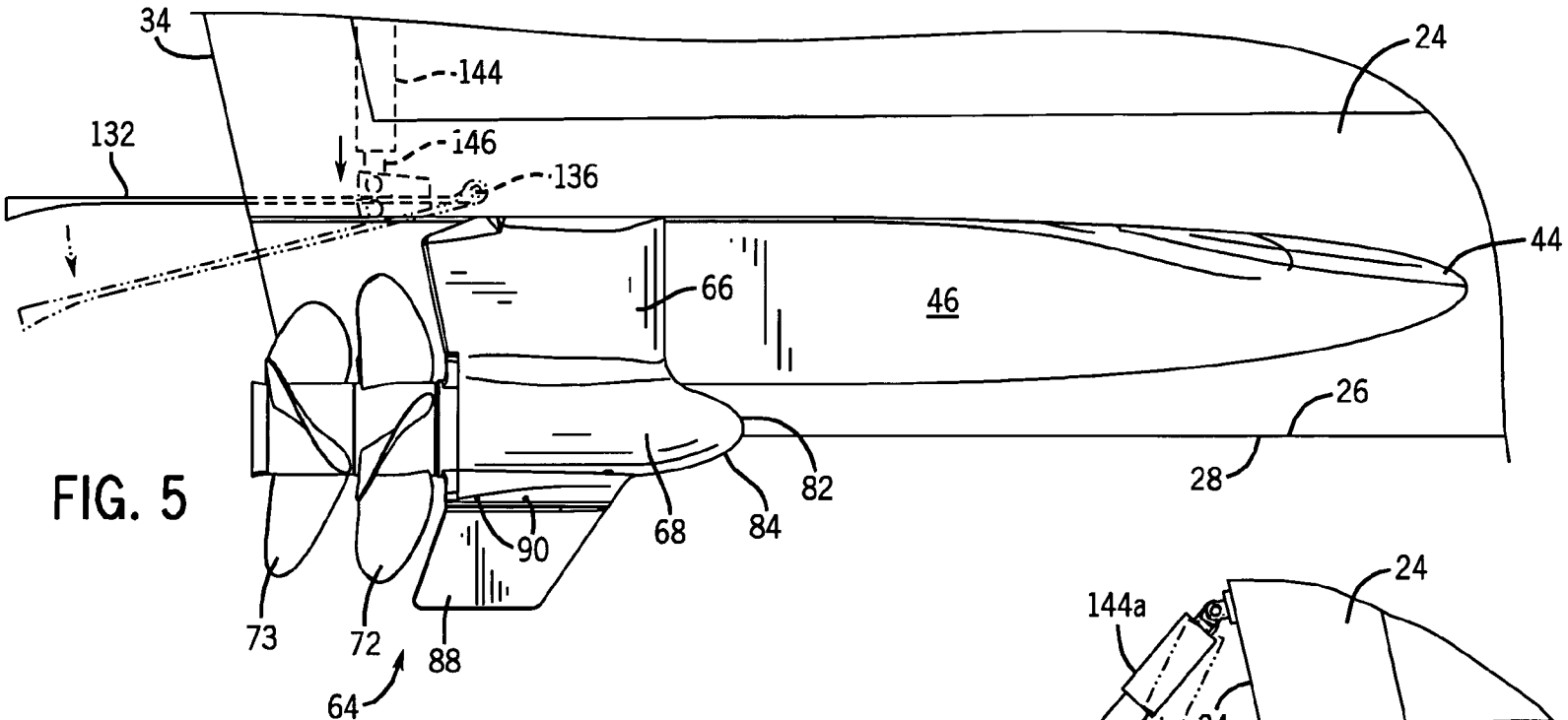
Figure 5A:
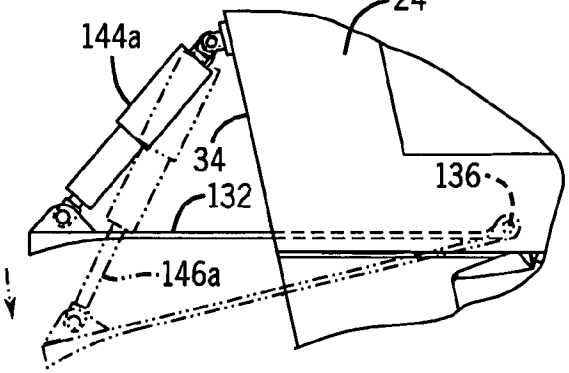
FIG. 5A is like a portion of FIG. 5 and shows an alternate embodiment.
Figure 5B:
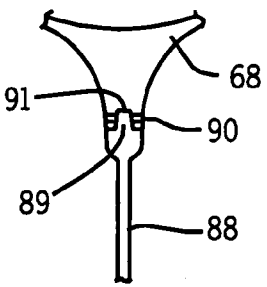
FIG. 5B is an enlarged rear elevation view of a portion of FIG. 5.

Tops 40 and 48 of port and starboard tunnels 38 and 46 are at a given vertical elevation, FIG. 4, spaced vertically above lower reach 28 of keel 26 to provide port and starboard tunnels 38 and 46 with a given vertical height receiving port and starboard marine propulsion devices 54 and 64 and raising same relative to keel 26, such that keel 26 at least partially protects port and starboard marine propulsion devices 54 and 64 from striking underwater objects, including grounding, during forward propulsion of the vessel. At least a portion of port driveshaft housing 56 is in port tunnel 38 and above open bottom 42 of port tunnel 38 at port lower hull surface 30. At least a portion of port lower gear case 58 is outside of port tunnel 38 and below open bottom 42 of port tunnel 38 at port lower hull surface 30. At least a portion of starboard driveshaft housing 66 is in starboard tunnel 46 and above open bottom 50 of starboard tunnel 46 at starboard lower hull surface 32. At least a portion of starboard lower gear case 68 is outside of starboard tunnel 46 and below open bottom 50 of starboard tunnel 46 at starboard lower hull surface 32. In one preferred embodiment, port and starboard lower gear cases 58 and 68 are horizontally aligned along a horizontal projection line at or above and transversely crossing lower reach 28 of keel 26. Port lower gear case 58 includes the noted port torpedo-shaped housing having a front nose 78 with a curved surface 80 extending downwardly and aft therefrom. In one preferred embodiment, front nose 78 is horizontally aligned with lower reach 28 of keel 26, such that underwater objects struck by port lower gear case 58 slide along curved surface 80 downwardly and aft from nose 78 of the noted port torpedo-shaped housing. Starboard lower gear case 68 includes the noted starboard torpedo-shaped housing having a front nose 82, FIG. 5, with a curved surface 84 extending downwardly and aft therefrom. In the noted one preferred embodiment, front nose 82 is horizontally aligned with lower reach 28 of keel 26, such that underwater objects struck by starboard lower gear case 68 slide along curved surface 84 extending downwardly and aft from nose 82 of the noted starboard torpedo-shaped housing. Further in the noted preferred embodiment, port and starboard marine propulsion devices 54 and 64 have respective port and starboard lower skegs 86 and 88 extending downwardly from respective port and starboard lower gear cases 58 and 68 to a lower reach at a vertical level below lower reach 28 of keel 26. Each of port and starboard lower skegs 86 and 88 is a breakaway skeg, e.g. mounted by frangible shear pins such as 90, FIG. 5, to its respective lower gear case, and breaking away from its respective lower gear case upon striking an underwater object, to protect the respective marine propulsion device. FIG. 5B is an enlarged rear elevation view of a portion of skeg 88 and gear case 68 of FIG. 5, with propellers 72 and 73 removed, and showing the mounting of skeg 88 to lower gear case 68 by a breakaway channel or tongue and groove arrangement, for example tongue 89 at the top of skeg 88, and groove or channel 91 at the bottom of lower gear case 68 receiving tongue 89 in breakaway manner upon shearing of frangible pins such as 90.

Figure 6:
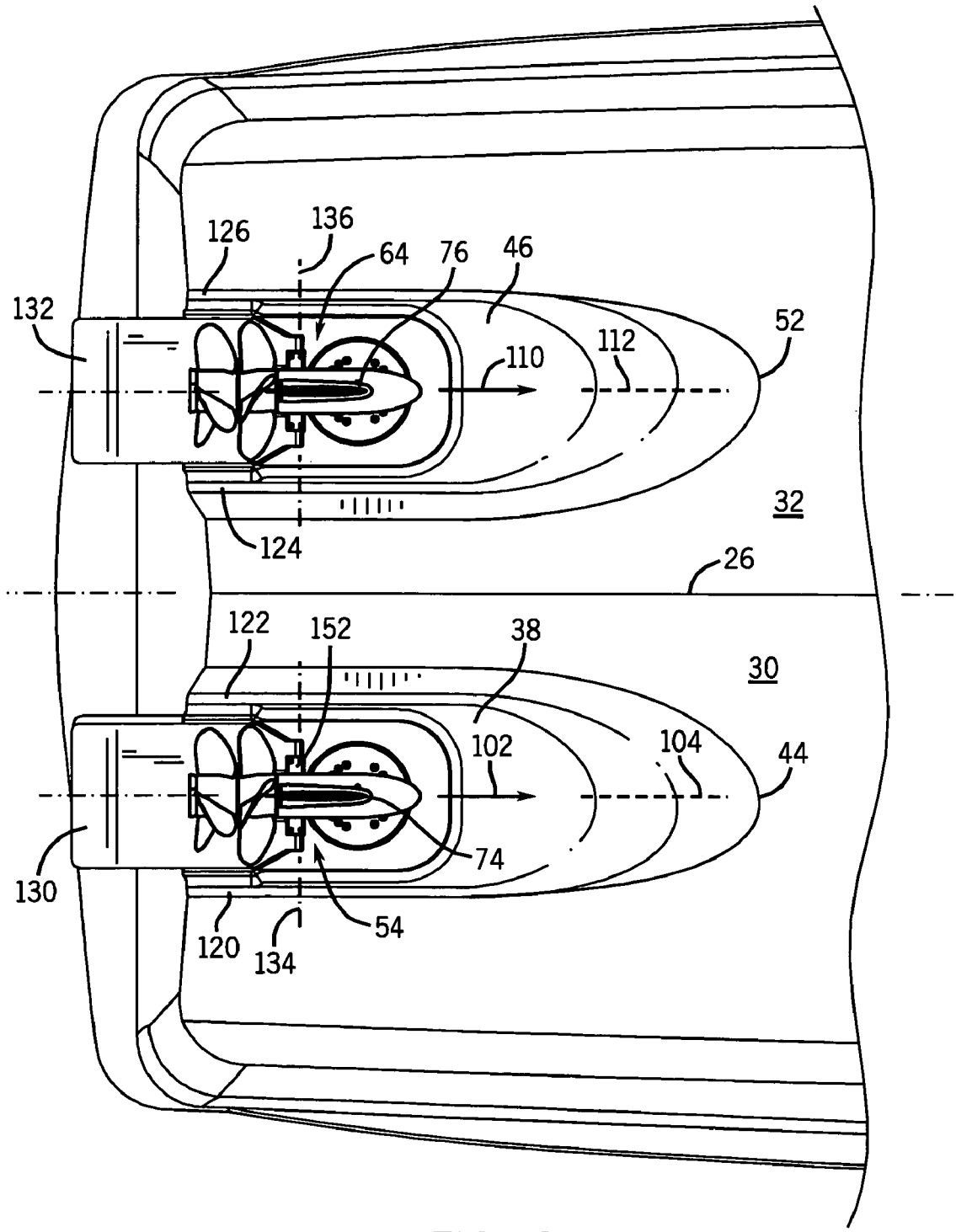
Figure 7:
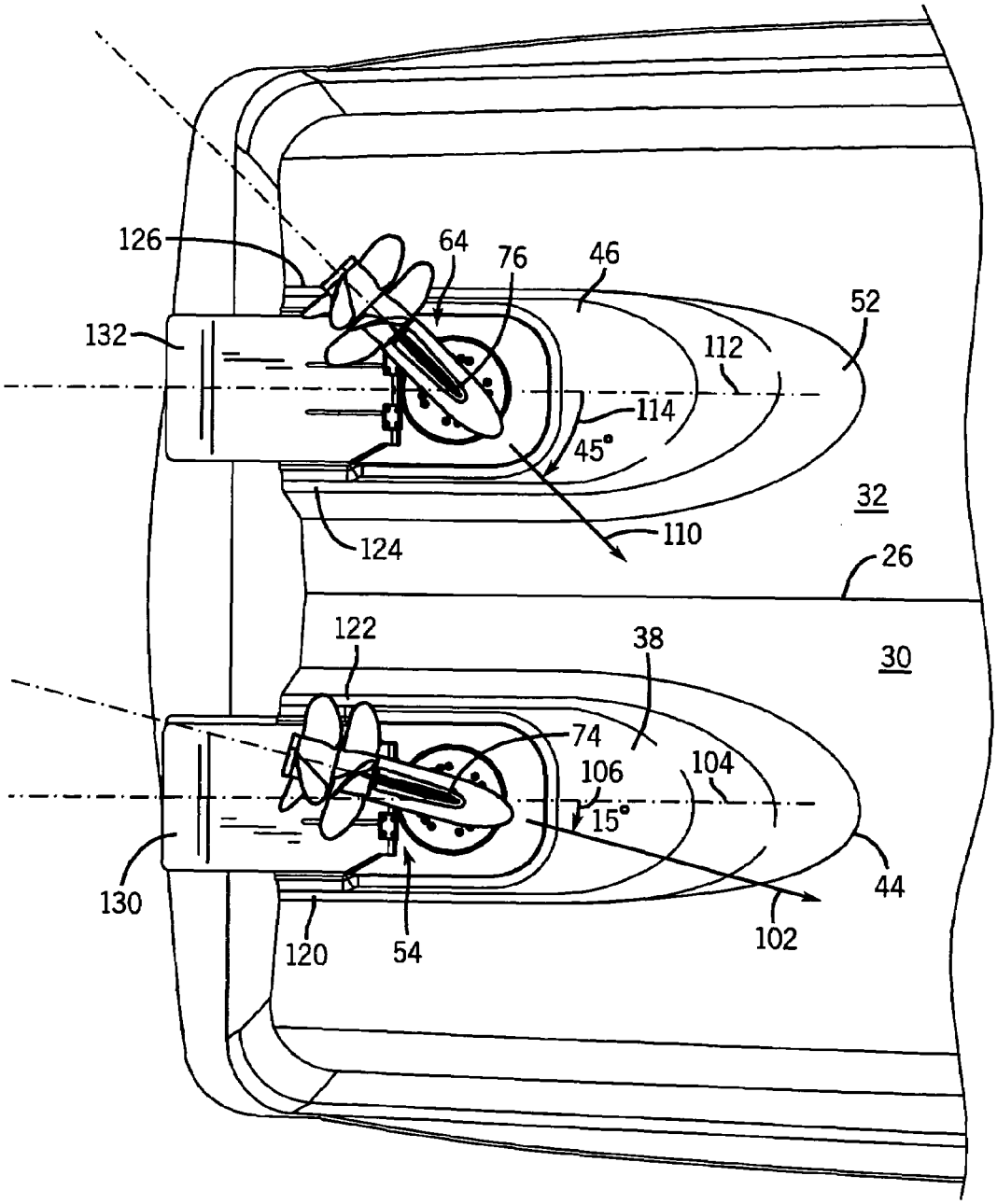
Figure 8:
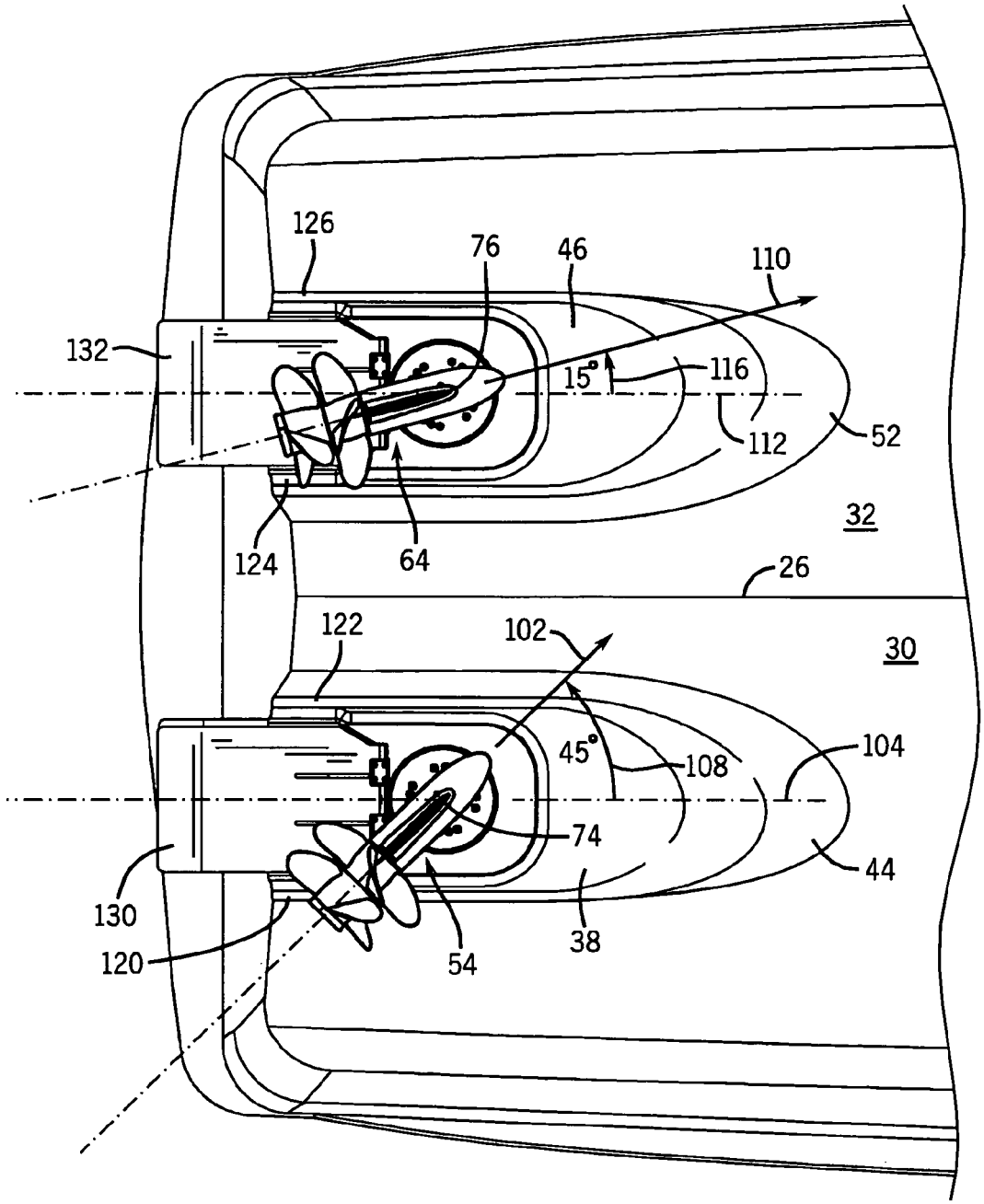

Port marine propulsion device 54 provides propulsion thrust along a port thrust direction 102, FIG. 6, along the noted at least one port propeller shaft 60. Port marine propulsion device 54 has a port reference position 104 with port thrust direction 102 pointing forwardly parallel to keel 26. Port marine propulsion device 54 is steerable about port steering axis 74 along a first angular range 106, FIG. 7, from port reference position 104 away from keel 26, e.g. clockwise in FIG. 7. Port marine propulsion device 54 is steerable about steering axis 72 along a second angular range 108, FIG. 8, from port reference position 104 towards keel 26, e.g. counterclockwise in FIG. 8. Angular ranges 106 and 108 are unequal, and port tunnel 38 is asymmetric, to be described. Starboard propulsion device 64 provides propulsion thrust along a starboard thrust direction 110 along the noted at least one starboard propeller shaft 70. Starboard marine propulsion device 64 has a starboard reference position 112, FIG. 6, with starboard thrust direction 110 pointing forwardly parallel to keel 26. Starboard marine propulsion device 64 is steerable about starboard steering axis 76 along a third angular range 114, FIG. 7, from starboard reference position 112 towards keel 26, e.g. clockwise in FIG. 7. Starboard marine propulsion device 64 is steerable about starboard steering axis 76 along a fourth angular range 116, FIG. 8, away from keel 26, e.g. counterclockwise in FIG. 8. Third and fourth angular ranges 114 and 116 are unequal, and starboard tunnel 46 is asymmetric, to be described. In one preferred embodiment, second angular range 108 is at least twice as great as first angular range 106, and in a further preferred embodiment, first angular range 106 is at least 15 degrees, and second angular range 108 is at least 45 degrees. In the noted preferred embodiment, third angular range 114 is at least twice as great as fourth angular range 116, and in the noted further preferred embodiment, third angular range 114 is at least 45 degrees, and fourth angular range 116 is at least 15 degrees. Marine propulsion devices 54 and 64 may be rotated and steered in unison with equal angular ranges, or may be independently controlled for various steering, docking, and position or station maintaining virtual anchoring functions, and for which further reference is made to the above-noted commonly owned co-pending '482 and '483 applications.

Port tunnel 38 has left and right port tunnel sidewalls 120 and 122 extending vertically between top 40 of port tunnel 38 and open bottom 42 of port tunnel 38 and port lower hull surface 30. Left and right port tunnel sidewalls 120 and 122 are laterally spaced by port driveshaft housing 56 therebetween. Right port tunnel sidewall 122 has a greater vertical height and a lower vertical reach than left port tunnel sidewall 120 and limits the span of first angular range 106 to be less than the span of second angular range 108. Starboard tunnel 46 has left and right starboard tunnel sidewalls 124 and 126 extending vertically between top 48 of starboard tunnel 46 and open bottom 50 of starboard tunnel 46 at starboard lower hull surface 32. Left and right starboard tunnel sidewalls 124 and 126 are laterally spaced by starboard driveshaft housing 66 therebetween. Left starboard tunnel sidewall 124 has a greater vertical height and a lower vertical reach than right starboard tunnel sidewall 126 and limits the span of fourth angular range 116 to be less than the span of third angular range 114.

Figure 9:
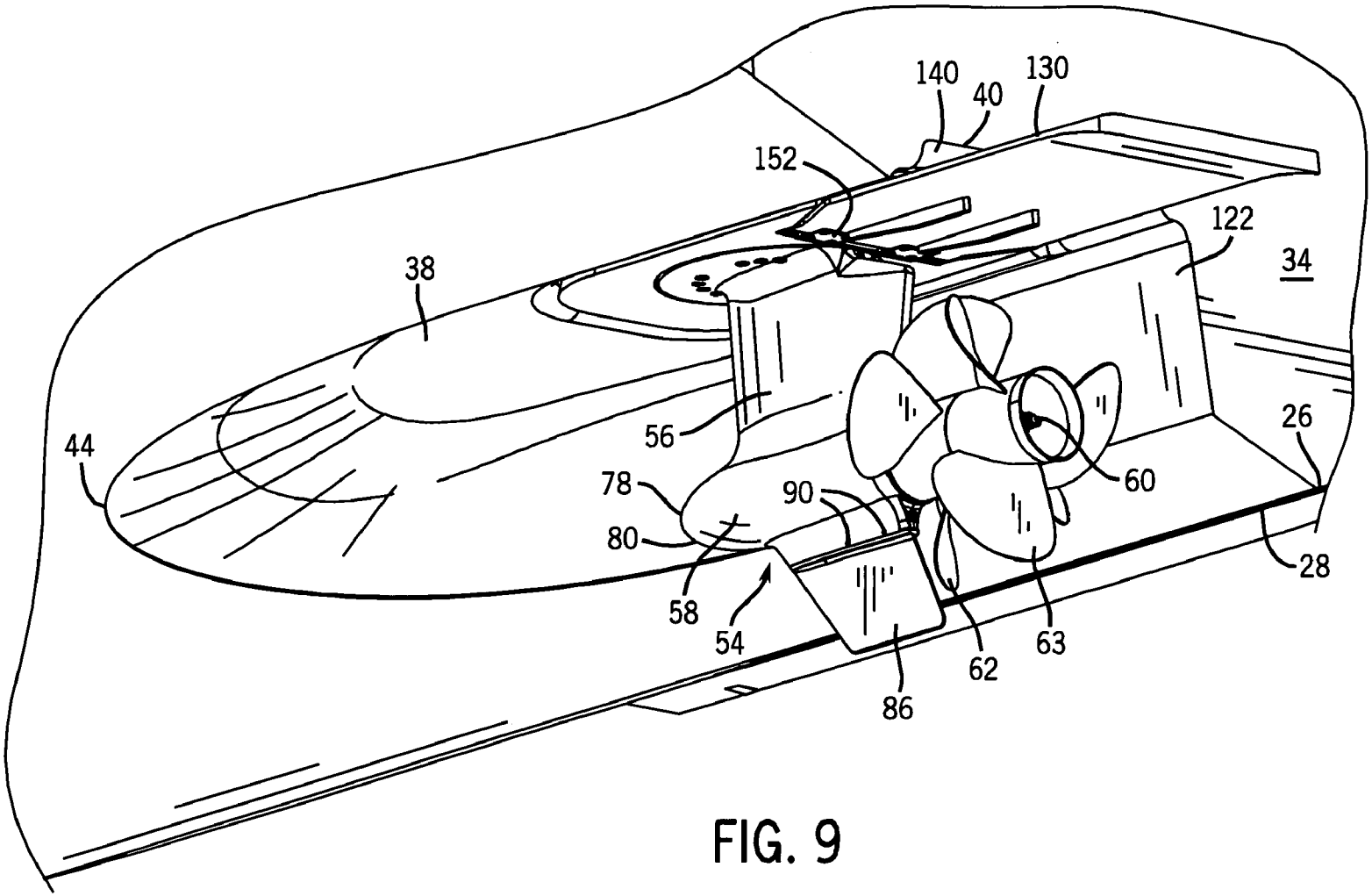
Figure 10:
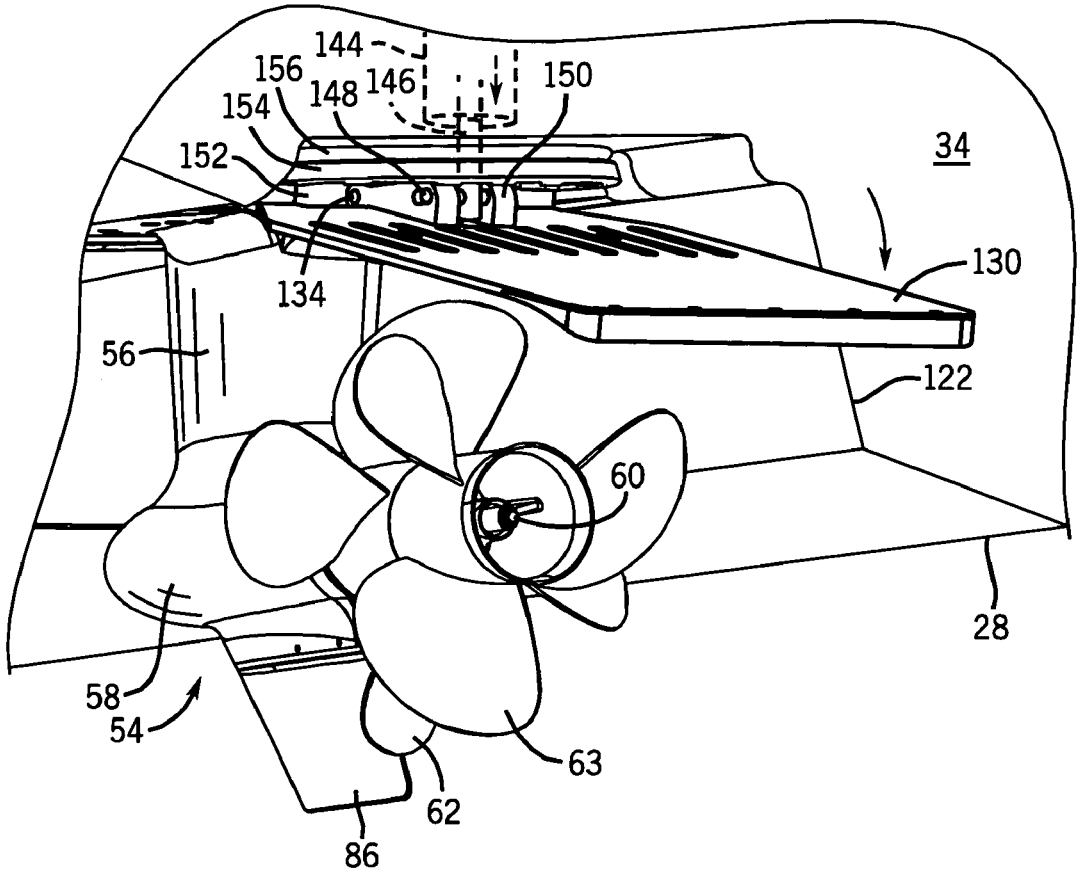

Port marine propulsion device 54 has a port trim tab 130 pivotally mounted thereto for contact by the water for adjusting vessel attitude and/or altering thrust vectors or otherwise affecting hydrodynamic operation of the vessel. Starboard marine propulsion device 64 has a starboard trim tab 132 pivotally mounted thereto. Port trim tab 130 is preferably pivotally mounted to port marine propulsion device 54 at a pivot axis 134, FIG. 6, aft of port driveshaft housing 56 and aft of port steering axis 74. Likewise, starboard trim tab 132 is preferably pivotally mounted to starboard marine propulsion device 64 at a pivot axis 136 aft of starboard driveshaft housing 66 and aft of starboard steering axis 76. Port trim tab 130 has an upwardly pivoted retracted position, FIGS. 1, 4, 9, and solid line in FIG. 5, and a downwardly pivoted extended position, FIG. 10, and dashed line in FIG. 5. The top 40, FIG. 4, of port tunnel 38 has a notch 140 receiving port trim tab 130 in the noted retracted position to enhance hydrodynamic profile by providing a smoother transition providing less restriction to water flow therepast. Starboard trim tab 132 likewise has an upwardly pivoted retracted position, and a downwardly pivoted extended position. The top 48 of starboard tunnel 46 has a notch 142 receiving starboard trim tab 132 in the noted retracted position to enhance hydrodynamic profile. Each trim tab may be actuated in conventional manner, e.g. hydraulically, e.g. by a hydraulic cylinder 144 having an extensible and retractable plunger or piston 146 engaging pivot pin 148 journaled to stanchions 150 of the respective trim tab. In an alternate embodiment, FIG. 5A, external hydraulic cylinder 144*a* has its piston 146*a* connected to the aft end of the trim tab, for a longer moment arm from the pivot axis of the trim tab if desired. In further embodiments, the trim tabs may be actuated electrically, e.g. by electrical reduction motors. The forward end of the trim tab is pivotally mounted at hinges such as 152 to mounting plate 154 of the marine propulsion device which is then mounted to the vessel hull and sealed thereto for example at sealing gasket 156. In the preferred embodiment, the forward end of the trim tab is pivotally mounted to the marine propulsion device and not to the vessel, and the aft end of the trim tab is movable in a vertical arc.

FIG. 11 is a side view taken from the above-noted commonly owned co-pending '482 and '483 applications and showing the arrangement of a marine propulsion device, such as 54 or 64, associated with a mechanism that is able to rotate the marine propulsion device about its respective steering axis 74 or 76. Although not visible in FIG. 11, the driveshaft of the marine propulsion device extends vertically and parallel to the steering axis and is connected in torque transmitting relation with a generally horizontal propeller shaft that is able to rotate about a propeller axis 61. The embodiment shown in FIG. 11 comprises two propellers 62 and 63, as above noted, that are attached to the propeller shaft 60. The motive force to drive the propellers 62 and 63 is provided by an internal combustion engine 160 that is located within the bilge of the marine vessel 22. The engine is configured with its crankshaft aligned for rotation about a horizontal axis. In one preferred embodiment, engine 160 is a diesel engine. Each of the two marine propulsion devices 54 and 64 is driven by a separate engine 160. In addition, each of the marine propulsion devices 54 and 64 are independently steerable about their respective steering axes 74 and 76. The steering axes are generally vertical and parallel to each other. They are intentionally not configured to be perpendicular to the bottom respective surface 30 and 32 of the hull. Instead, they are generally vertical and intersect the respective bottom surface 30 and 32 of the hull at an angle that is not equal to 90 degrees when the bottom surface of the hull is a V-type hull or any other shape which does not include a flat bottom. Driveshaft housings 56 and 66 and gear case torpedo housings 58 and 68 contain rotatable shafts, gears, and bearings which support the shafts and connect the driveshaft to the propeller shaft for rotation of the propellers. No source of motive power is located below the hull surface. The power necessary to rotate the propellers is solely provided by the internal combustion engine. The marine vessel maneuvering system in one preferred embodiment is that provided in the noted commonly owned co-pending '482 and '483 applications, allowing the operator of the marine vessel to provide maneuvering commands to a microprocessor which controls the steering movements and thrust magnitudes of two marine propulsion devices 54, 64 to implement those maneuvering commands, e.g. steering, docking, and position or station maintaining virtual anchoring functions, and the like, as above noted.

Present Application

FIGS. 12-16 illustrate the present invention and use like reference numerals from above where appropriate to facilitate understanding.

Figure 1:
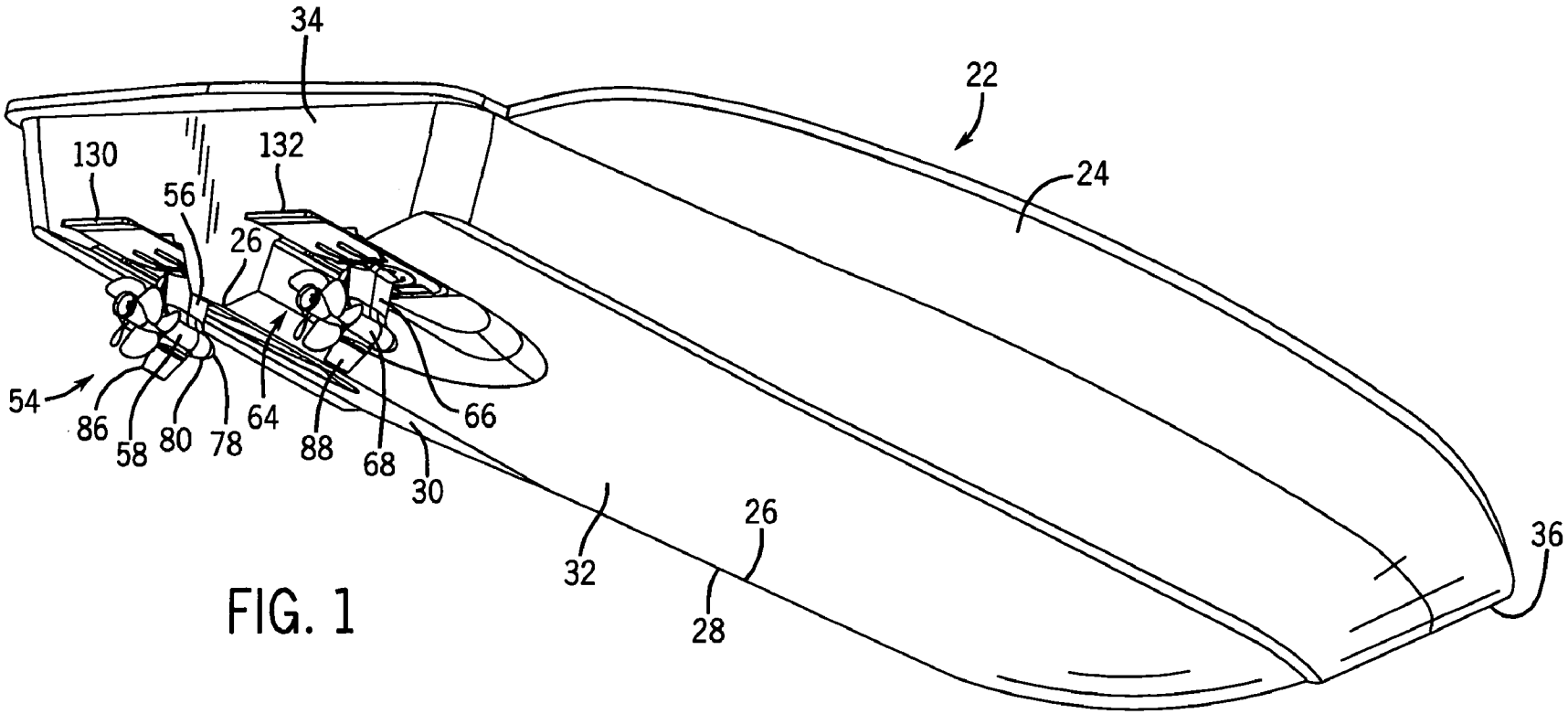
FIGS. 1-11 are taken from the noted parent '718 application.

As noted above, the marine vessel and drive combination includes marine vessel 22, FIG. 1, having a hull 24 having a longitudinally extending keel 26 with port and starboard lower hull surfaces 30 and 32, respectively, extending upwardly and laterally distally oppositely from keel 26 in V-shaped relation, FIG. 4. Hull 24 extends forwardly from a stern 34 to a bow 36. Port and starboard tunnels 38 and 46, respectively, are formed in the port and starboard lower hull surfaces 30 and 32, respectively. Port tunnel 38 has a top 40, FIG. 4, spaced above an open bottom 42 at port lower hull surface 30. Port tunnel 38 opens aft at stern 34 and extends forwardly therefrom and has a closed forward end 44 aft of bow 36. Starboard tunnel 46 has a top 48 spaced above an open bottom 50 at starboard lower hull surface 32. Starboard tunnel 46 opens aft at stern 34 and extends forwardly therefrom and has a closed forward end 52 aft of bow 36. Port and starboard marine propulsion devices 54 and 64, respectively, extend downwardly in respective port and starboard tunnels 38 and 46 through respective tops 40 and 48 of port and starboard tunnels 38 and 46 through respective openings therein, one of which is shown in FIG. 12 at 162 which is an opening extending through the hull at top 40 of port tunnel 38 formed in port lower hull surface 30.

Opening 162, FIGS. 12, 13, has an inner perimeteral edge 164 facing laterally inwardly toward steering axis 74 and having distally opposite upper and lower surfaces 166 and 168. A pair of mounting plates are provided by upper and lower mounting plates 170 and 172, respectively, mounting marine propulsion device 54 to hull 24 at opening 162 formed through the top 40 of tunnel 38. A resiliently compressible elastomeric grommet 174, FIGS. 12-14, has a C-shape in cross-section, which C-shaped cross-section has first, second and third resiliently compressible segments 176, 178, 180, respectively. First segment 176 is compressed between and seals upper surface 166 of opening 162 to upper mounting plate 170. Second segment 178 is compressed between and seals inner perimeteral edge 164 of opening 162 to each of mounting plates 170 and 172. Third segment 180 is compressed between and seals lower surface 168 of opening 162 to lower mounting plate 172.

Upper mounting plate 170 has first and second sealing surfaces 184 and 186 respectively engaging the noted first and second segments 176 and 178 of grommet 174. Lower mounting plate 172 has third and fourth sealing surfaces 188 and 190 respectively engaging the noted second and third segments 178 and 180 of grommet 174. Second segment 178 of grommet 174 has an upper span 192 sealingly engaging upper mounting plate 170 at second sealing surface 186. Second segment 178 of grommet 174 has a lower span 194 sealingly engaging lower mounting plate 172 at third sealing surface 188.

Inner perimeteral edge 164 of opening 162 faces laterally radially inwardly along a first lateral plane 196, FIG. 13. First sealing surface 184 and first segment 176 of grommet 174 lie in a second lateral plane 198 parallel to first lateral plane 196 and spaced thereabove. Fourth sealing surface 190 and third segment 180 of grommet 174 lie in a third lateral plane 200 parallel to first lateral plane 196 and spaced therebelow.

Upper and lower mounting plates 170 and 172 are clamped to each other by bolts such as 202 at respective first and second facing surfaces 204 and 206, respectively. Upper mounting plate 170 has a first divergent surface 208 diverging upwardly from first facing surface 204. Lower mounting plate 172 has a second divergent surface 210 diverging downwardly from second facing surface 206. Second sealing surface 186 is constituted by at least a portion of first divergent surface 208. Third sealing surface 188 is constituted by at least a portion of second divergent surface 210.

First divergent surface 208 has an upper portion 212 extending upwardly to meet first sealing surface 184. First divergent surface 208 has a lower portion 214 extending downwardly from upper portion 212 to meet first facing surface 204. Second divergent surface 210 has a lower portion 216 extending downwardly to meet fourth sealing surface 190. Second divergent surface 210 has an upper portion 218 extending upwardly from lower portion 216 to meet second facing surface 206. Second sealing surface 186 extends along at least a portion of upper portion 212 of first divergent surface 208. Third sealing surface 188 extends along at least a portion of lower portion 216 of second divergent surface 210.

FIGS. 15 and 16 show an alternate embodiment and use like reference numerals from above with a postscript "a"

where appropriate to facilitate understanding. The embodiment of FIGS. 15, 16 is preferred where it is desired to permit excess bulging of the grommet into the gap between the mounting plates upon clamping of the mounting plates to each other, while still maintaining a tight flush fit of facing surfaces 204*a* and 206*a*, FIG. 16. Grommet 174*a*, FIG. 15, has an initial pre-compressed pre-clamped shape with a concave recess 220 at second segment 178*a*. In the clamped condition, FIG. 16, lower portion 214*a* of first divergent surface 208*a* and upper portion 218*a* of second divergent surface 210*a* are each laterally spaced from second segment 178*a* of grommet 174*a* by a gap 222 permitting excess bulging of grommet 174*a*, if needed, upon clamping of mounting plates 170*a* and 172*a* to each other. The grommet may bulge into gap 222 if needed, to assure a tight flush fit of facing surfaces 204*a* and 206*a* of facing surfaces of 204*a* and 206*a* against each other in abutting relation at junction 224, 224*a*. Inner perimeteral edge 164, 164*a* of opening 162, 162*a* faces laterally radially inwardly along lateral plane 196, 196*a*. Inner perimeteral edge 164, 164*a* and second segment 178, 178*a* of grommet 174, 174*a* and junction 224, 224*a* are co-planar along lateral plane 196, 196*a*.

In the foregoing description, certain terms have been used for brevity, clearness, and understanding. No unnecessary limitations are to be implied therefrom beyond the requirement of the prior art because such terms are used for descriptive purposes and are intended to be broadly construed. The different configurations, systems, and method steps described herein may be used alone or in combination with other configurations, systems, and method steps. It is to be expected that various equivalents, alternatives and modifications are possible within the scope of the appended claims.

What is claimed is:

1. A marine vessel and drive combination comprising a marine vessel comprising a hull extending longitudinally fore-aft between a bow and a stern, a marine propulsion device extending downwardly along a steering axis through said hull and steerable about said steering axis, said hull having an opening receiving said marine propulsion device extending therethrough, said opening having an inner perimeteral edge facing laterally radially inwardly toward said steering axis and having distally opposite upper and lower surfaces, a pair of mounting plates comprising upper and lower mounting plates mounting said marine propulsion device to said hull at said opening, a grommet having a C-shape in cross-section, which C-shaped cross-section has first, second and third resiliently compressible segments, said first segment being compressed between and sealing said upper surface of said opening to said upper mounting plate, said second segment being compressed between and sealing said inner perimeteral edge of said opening to each of said mounting plates, said third segment being compressed between and sealing said lower surface of said opening to said lower mounting plate, wherein said upper mounting plate has first and second sealing surfaces respectively engaging said first and second segments of said grommet, said lower mounting plate has third and fourth sealing surfaces respectively engaging said second and third segments of said grommet.

2. The marine vessel and drive combination according to claim 1 wherein said second segment of said grommet has an upper span sealingly engaging said upper mounting plate at said second sealing surface, and has a lower span sealingly engaging said lower mounting plate at said third sealing surface.

3. The marine vessel and drive combination according to claim 2 wherein:

said inner perimeteral edge faces laterally radially inwardly along a first lateral plane;

said first sealing surface and said first segment of said grommet lie in a second lateral plane parallel to said first lateral plane and spaced thereabove;

said fourth sealing surface and said third segment of said grommet lie in a third lateral plane parallel to said first lateral plane and spaced therebelow.

4. The marine vessel and drive combination according to claim 2 wherein:

said upper and lower mounting plates are clamped to each other at respective first and second facing surfaces;

said upper mounting plate has a first divergent surface diverging upwardly from said first facing surface;

said lower mounting plate has a second divergent surface diverging downwardly from said second facing surface;

said second sealing surface is constituted by at least a portion of said first divergent surface;

said third sealing surface is constituted by at least a portion of said second divergent surface.

5. The marine vessel and drive combination according to claim 4 wherein:

said first divergent surface has an upper portion extending upwardly to meet said first sealing surface;

said first divergent surface has a lower portion extending downwardly from said upper portion of said first divergent surface to meet said first facing surface;

said second divergent surface has a lower portion extending downwardly to meet said fourth sealing surface;

said second divergent surface has an upper portion extending upwardly from said lower portion of said second divergent surface to meet said second facing surface;

said second sealing surface extends along at least a portion of said upper portion of said first divergent surface;

said third sealing surface extends along at least a portion of said lower portion of said second divergent surface.

6. The marine vessel and drive combination according to claim 5 wherein said lower portion of said first divergent surface and said upper portion of said second divergent surface are each laterally spaced from said second segment of said grommet by a gap permitting excess bulging of said grommet upon clamping of said mounting plates to each other.

7. The marine vessel and drive combination according to claim 2 wherein:

said upper and lower mounting plates are clamped together at a junction;

said upper mounting plate has a first divergent surface diverging upwardly from said junction;

said lower mounting plate has a second divergent surface diverging downwardly from said junction;

said second sealing surface is constituted by at least a portion of said first divergent surface;

said third sealing surface is constituted by at least a portion of said second divergent surface;

said first divergent surface has an upper portion extending upwardly to meet said first sealing surface;

said first divergent surface has a lower portion extending downwardly from said upper portion of said first divergent surface to meet said junction;

said second divergent surface has a lower portion extending downwardly to meet said fourth sealing surface;

said second divergent surface has an upper portion extending upwardly from said lower portion of said second divergent surface to meet said junction;

said second sealing surface extends along at least said upper portion of said first divergent surface;

said third sealing surface extends along at least said lower portion of said second divergent surface;

said second segment of said grommet is laterally between said inner perimeteral edge and said first and second divergent surfaces.

8. The marine vessel and drive combination according to claim 7 wherein said inner perimeteral edge faces laterally radially inwardly along a lateral plane, and wherein said inner perimeteral edge and said second segment of said grommet and said junction are co-planar along said lateral plane.

9. A marine vessel and drive combination comprising a marine vessel comprising a hull extending longitudinally fore-aft between a bow and a stern, said hull having a lower hull surface, a tunnel formed in said lower hull surface, said tunnel having a top spaced above an open bottom, a marine propulsion device extending downwardly along a steering axis through said hull and downwardly in said tunnel and steerable about said steering axis, said hull at said top of said tunnel having an opening receiving said marine propulsion device extending therethrough, said opening having an inner perimeteral edge facing laterally radially inwardly toward said steering axis and having distally opposite upper and lower surfaces, a pair of mounting plates comprising upper and lower mounting plates mounting said marine propulsion device to said hull at said opening, a grommet having a C-shape in cross-section, which C-shaped cross-section has first, second and third resiliently compressible segments, said first segment being compressed between and sealing said upper surface of said opening to said upper mounting plate, said second segment being compressed between and sealing said inner perimeteral edge of said opening to each of said mounting plates, said third segment being compressed between and sealing said lower surface of said opening to said lower mounting plate.

10. The marine vessel and drive combination according to claim 9 wherein said tunnel opens aft at said stern and extends forwardly therefrom and has a closed forward end aft of said bow.

11. The marine vessel and drive combination according to claim 10 wherein said marine propulsion device comprises a driveshaft housing extending downwardly in said tunnel to a lower gearcase supporting at least one propeller shaft driving at least one propeller, and at least a portion of said driveshaft housing is in said tunnel and above said open bottom of said tunnel at said lower hull surface, and at least a portion of said lower gearcase is outside of said tunnel and below said open bottom of said tunnel at said lower hull surface.

12. The marine vessel and drive combination according to claim 9 wherein:

said upper mounting plate has first and second sealing surfaces respectively engaging said first and second segments of said grommet;

said lower mounting plate has third and fourth sealing surfaces respectively engaging said second and third segments of said grommet;

said second segment of said grommet has an upper span sealingly engaging said upper mounting plate at said second sealing surface, and has a lower span sealingly engaging said lower mounting plate at said third sealing surface;

said upper and lower mounting plates are clamped to each other at respective first and second facing surfaces;

said upper mounting plate has a first divergent surface diverging upwardly from said first facing surface;

said lower mounting plate has a second divergent surface diverging downwardly from said second facing surface;

said second sealing surface is constituted by at least a portion of said first divergent surface;

said third sealing surface is constituted by at least a portion of said second divergent surface;

said first divergent surface has an upper portion extending upwardly to meet said first sealing surface;

said first divergent surface has a lower portion extending downwardly from said upper portion of said first divergent surface to meet said first facing surface;

said second divergent surface has a lower portion extending downwardly to meet said fourth sealing surface;

said second divergent surface has an upper portion extending upwardly from said lower portion of said second divergent surface to meet said second facing surface;

said second sealing surface extends along at least a portion of said upper portion of said first divergent surface;

said third sealing surface extends along at least a portion of said lower portion of said second divergent surface.

13. The marine vessel and drive combination according to claim 9 wherein:

said upper mounting plate has first and second sealing surfaces respectively engaging said first and second segments of said grommet;

said lower mounting plate has third and fourth sealing surfaces respectively engaging said second and third segments of said grommet;

said second segment of said grommet has an upper span sealingly engaging said upper mounting plate at said second sealing surface, and has a lower span sealingly engaging said lower mounting plate at said third sealing surface;

said upper and lower mounting plates are clamped together at a junction;

said upper mounting plate has a first divergent surface diverging upwardly from said junction;

said lower mounting plate has a second divergent surface diverging downwardly from said junction;

said second sealing surface is constituted by at least a portion of said first divergent surface;

said third sealing surface is constituted by at least a portion of said second divergent surface;

said first divergent surface has an upper portion extending upwardly to meet said first sealing surface;

said first divergent surface has a lower portion extending downwardly from said upper portion of said first divergent surface to meet said junction;

said second divergent surface has a lower portion extending downwardly to meet said fourth sealing surface;

said second divergent surface has an upper portion extending upwardly from said lower portion of said second divergent surface to meet said junction;

said second sealing surface extends along at least said upper portion of said first divergent surface;

said third sealing surface extends along at least said lower portion of said second divergent surface;

said second segment of said grommet is laterally between said inner perimeteral edge and said first and second divergent surfaces.

14. A marine vessel and drive combination comprising a marine vessel, and a marine propulsion device extending from said vessel and having a water-engaging propulsor for propelling said vessel through a body of water, a trim tap movably mounted to said marine propulsion device for contact by said water for affecting hydrodynamic operation of said vessel, said vessel comprising a hull extending longitudinally fore-aft between a bow and a stern, said marine propulsion device extending downwardly along a steering axis through said hull and steerable about said steering axis, said hull having an opening receiving said marine propulsion device extending therethrough, said opening having an inner perimeteral edge facing laterally radially inwardly toward said steering axis and having distally opposite upper and lower surfaces, a pair of mounting plates comprising upper and lower mounting plates mounting said marine propulsion device to said hull at said opening, a grommet having a C-shape in cross-section, which C-shaped cross-section has first, second and third resiliently compressible segments, said first segment being compressed between and sealing said upper surface of said opening to said upper mounting plate, said second segment being compressed between and sealing said inner perimeteral edge of said opening to each of said mounting plates, said third segment being compressed between and sealing said lower surface of said opening to said lower mounting plate.

15. The marine vessel and drive combination according to claim 14 wherein said trim tab has a forward end pivotally mounted to said marine propulsion device, and an aft end movable in a vertical arc, and wherein said forward end of said trim tab is pivotally mounted to said marine propulsion device and not to said hull.

16. The marine vessel and drive combination according to claim 14 wherein said hull has a lower hull surface, and comprising a tunnel formed in said lower hull surface, said tunnel having a top spaced above an open bottom, said marine propulsion device extending downwardly along said steering axis through said hull and downwardly in said tunnel and steerable about said steering axis, said opening being at said top of said tunnel.

17. The marine vessel and drive combination according to claim 16 wherein said marine propulsion device comprises a driveshaft housing extending downwardly in said tunnel to a lower gearcase supporting at least one propeller shaft driving at least one propeller, and wherein said trim tab is pivotally mounted to said marine propulsion device at a pivot axis aft of said steering axis.

18. The marine vessel and drive combination according to claim 14 wherein:

said upper mounting plate has first and second sealing surfaces respectively engaging said first and second segments of said grommet;

said lower mounting plate has third and fourth sealing surfaces respectively engaging said second and third segments of said grommet;

said second segment of said grommet has an upper span sealingly engaging said upper mounting plate at said second sealing surface, and has a lower span sealingly engaging said lower mounting plate at said third sealing surface;

said upper and lower mounting plates are clamped to each other at respective first and second facing surfaces;

said upper mounting plate has a first divergent surface diverging upwardly from said first facing surface;

said lower mounting plate has a second divergent surface diverging downwardly from said second facing surface;

said second sealing surface is constituted by at least a portion of said first divergent surface;

said third sealing surface is constituted by at least a portion of said second divergent surface;

said first divergent surface has an upper portion extending upwardly to meet said first sealing surface;

said first divergent surface has a lower portion extending downwardly from said upper portion of said first divergent surface to meet said first facing surface;

said second divergent surface has a lower portion extending downwardly to meet said fourth sealing surface;

said second divergent surface has an upper portion extending upwardly from said lower portion of said second divergent surface to meet said second facing surface;

said second sealing surface extends along at least a portion of said upper portion of said first divergent surface;

said third sealing surface extends along at least a portion of said lower portion of said second divergent surface.

19. The marine vessel and drive combination according to claim 14 wherein:

said upper mounting plate has first and second sealing surfaces respectively engaging said first and second segments of said grommet;

said lower mounting plate has third and fourth sealing surfaces respectively engaging said second and third segments of said grommet;

said second segment of said grommet has an upper span sealingly engaging said upper mounting plate at said second sealing surface, and has a lower span sealingly engaging said lower mounting plate at said third sealing surface;

said upper and lower mounting plates are clamped together at a junction;

said upper mounting plate has a first divergent surface diverging upwardly from said junction;

said lower mounting plate has a second divergent surface diverging downwardly from said junction;

said second sealing surface is constituted by at least a portion of said first divergent surface;

said third sealing surface is constituted by at least a portion of said second divergent surface;

said first divergent surface has an upper portion extending upwardly to meet said first sealing surface;

said first divergent surface has a lower portion extending downwardly from said upper portion of said first divergent surface to meet said junction;

said second divergent surface has a lower portion extending downwardly to meet said fourth sealing surface;

said second divergent surface has an upper portion extending upwardly from said lower portion of said second divergent surface to meet said junction;

said second sealing surface extends along at least said upper portion of said first divergent surface;

said third sealing surface extends along at least said lower portion of said second divergent surface;

said second segment of said grommet is laterally between said inner perimeteral edge and said first and second divergent surfaces.

* * * * *